US007331730B2

(12) United States Patent
Fukui et al.

(10) Patent No.: US 7,331,730 B2
(45) Date of Patent: Feb. 19, 2008

(54) RETRACTABLE WRITING MATERIAL

(75) Inventors: Hisao Fukui, Tokyo (JP); Akinori Furuichi, Tokyo (JP); Yasushi Miyashita, Tokyo (JP)

(73) Assignee: Pentel Kabushiki Kaisha (JP)

( * ) Notice: Subject to any disclaimer, the term of this patent is extended or adjusted under 35 U.S.C. 154(b) by 10 days.

(21) Appl. No.: 10/535,171

(22) PCT Filed: Nov. 12, 2003

(86) PCT No.: PCT/JP03/14355

§ 371 (c)(1),
(2), (4) Date: May 16, 2005

(87) PCT Pub. No.: WO2004/045865

PCT Pub. Date: Jun. 3, 2004

(65) Prior Publication Data

US 2006/0147248 A1 Jul. 6, 2006

(30) Foreign Application Priority Data

Nov. 18, 2002 (JP) ..... 2002-333456
May 29, 2003 (JP) ..... 2003-151847
Aug. 27, 2003 (JP) ..... 2003-302671

(51) Int. Cl.
*B43K 5/16* (2006.01)
*B43K 7/12* (2006.01)
*B43K 24/02* (2006.01)

(52) U.S. Cl. ..... 401/108

(58) Field of Classification Search ..... 401/99, 401/107–109
See application file for complete search history.

(56) References Cited

U.S. PATENT DOCUMENTS 5,048,990 A 9/1991 Hashimoto et al. ..... 401/107
5,915,867 A * 6/1999 Hashimoto ..... 401/108

FOREIGN PATENT DOCUMENTS

JP 06053438 10/1988
JP 07098437 11/1989
JP 07329486 12/1995

* cited by examiner

*Primary Examiner*—Huyen Le
(74) *Attorney, Agent, or Firm*—Adams & Wilks

(57) ABSTRACT

This is a retractable-nib writing tool having a retractable writing body in a shaft tube and having a sealing lid and a sealing tube which seal the writing nib of the writing body in association with the forward and backward movements of the writing body. In this retractable-nib writing tool, the sealing lid and a guide tube fixed to the writing body are linked by a plurality of thin line portions, the sealing lid and thin line portions are formed integrally, and the sealing lid is opened and closed relative to the sealing tube by the forward and backward movements of those thin line portions. This retractable-nib writing tool can securely seal, when the writing body is retracted, the writing nib at the tip by the sealing lid and the sealing tube and thereby prevent the writing body from drying.

20 Claims, 8 Drawing Sheets

RETRACTABLE WRITING MATERIAL

CROSS-REFERENCE TO RELATED APPLICATIONS

This application is a U.S. national stage application of copending International Application No. PCT/JP2003/014355, filed Nov. 12, 2003, claiming priority dates of Nov. 18, 2002; May 29, 2003; and Aug. 27, 2003, and published in a non-English language.

TECHNICAL FIELD

The present invention relates to a retractable-nib writing tool having a retractable writing body in a shaft tube and a sealing lid and a sealing tube for sealing the writing nib of the writing body in association with the forward and backward movements of the writing body.

BACKGROUND ART

Known conventional retractable-nib writing tools include, for instance, a cap-less writing tool described in Japanese Patent Publication No. 5-68360. In this cap-less writing tool, a sealing tube having a through hole through which a writing nib at the tip of a writing body is provided within the body, a sealing lid is swingably fitted near the tip hole of this sealing tube and, when the writing nib is placed in a retracted state, the sealing lid is closed by a string-shaped member urged by a springy member to keep the writing nib in a sealed state. Such a writing tool, as it requires neither capping nor uncapping, can provide the effect of easier use.

However, since the sealing lid is linked to the sealing tube by a hinge in the cap-less writing tool mentioned above, not only the sealing will be insufficient where the elastic force of the springy member is too small but also, even if the elastic force is large, the sealing may still be insufficient. Thus, as the side where the string-shaped member is fitted is pulled more strongly, a gap is formed near the hinge fixed to the sealing tube to make the sealing incomplete. In other words, since the direction of the force which presses the sealing lid toward the sealing tube is not in parallel to the longer axis of the writing tool, strong pulling would make the balance disturbed by the tension of the string-shaped member and the extension of the hinge to adversely affect the sealing performance.

SUMMARY OF THE INVENTION

An object of the present invention is to provide a retractable-nib writing tool capable, when the writing body is retracted, of securely sealing the writing nib at the tip by the combination of the sealing lid and the sealing tube and thereby preventing the writing body from drying.

A retractable-nib writing tool according to the invention has a retractable writing body in a shaft tube and has a sealing lid and a sealing tube which seal the writing nib of the writing body in association with the forward and backward movements of the writing body, wherein the sealing lid and a guide tube fixed to the writing body are linked by a plurality of thin line portions, the sealing lid and thin line portions are formed integrally, and the sealing lid is opened and closed relative to the sealing tube by the forward and backward movements of the thin line portions.

In the retractable-nib writing tool, it is preferable for the plurality of thin line portions to have a structure which permits bending and deformation.

In the retractable-nib writing tool, it is possible to provide means of regulating the forward motion of at least one thin line portion out of the plurality of thin line portions which are advanced by the forward motion of the guide tube.

In the retractable-nib writing tool, it is possible to regulate the forward motion of at least one thin line portion out of the plurality of thin line portions which are advanced by the forward motion of the guide tube and to structure other thin line portions to be bendable and deformable.

In the retractablenib writing tool, it is possible to loosely insert into the guide tube at least one thin line portion out of the plurality of thin line portions which are advanced by the forward motion of the guide tube and provide engaging means to engage with the guide tube.

Further in the retractable-nib writing tool, it is desirable for both the sealing force between the sealing lid and the sealing tube and the sealing force between the writing nib and the sealing tube to be set to 50 to 100 kPa.

Also, in the retractable-nib writing tool, it is desirable that at least either one of the sealing lid and the sealing tube is composed of a material whose water vapor transmissivity prescribed under ASTMF 1249 is not more than 3.0 (g. mm/$m^2$. day) under the condition of 37.8° C. (90% RH).

Further a retractable-nib writing tool according to the invention has a retractable writing body in a shaft tube and has a sealing lid and a sealing tube which seal the writing nib of the writing body in association with the forward and backward movements of that writing body, wherein the sealing tube is fixed within the shaft tube, the sealing lid and a guide tube are arranged respectively ahead of and behind this sealing tube to fix the guide tube to the writing body and the guide tube and the sealing lid are linked with a plurality of flexible thin line portions, so configured that, while an opening at the forward end of the sealing tube is closed as the plurality of thin line portions keep the sealing lid in a state of being pressed against the sealing tube when the writing body is in a retracted position, the sealing lid turns to open the opening at the forward end of the sealing tube as the forward movement of any of the plurality of thin line portions relative to the sealing tube is restricted and those of the rest of the thin line portions are permitted when the writing body is to move forward.

In the retractable-nib writing tool, it is possible for the thin line portion whose forward movement is to be regulated, out of the plurality of thin line portions, is provided with a bulged portion, and the outer circumferential part of the sealing tube is provided with engaging step portions to engage with the bulged portion when the writing body moves forward.

In the retractable-nib writing tool, it is possible to use a structure in which the sealing lid and the thin line portions are integrally formed.

In the retractable-nib writing tool, it is possible for a springy member to intervene between the sealing tube and the guide tube and, when the writing body is in a retracted position, the plurality of thin line portions to keep the sealing lid in a state of being pressed against the sealing tube by the urging of the springy member. In this case, it is preferable that the plurality of thin line portions be arranged between the guide tube and the sealing lid so that, when the writing body is in the retracted position, the direction of the force working from the plurality of thin line portions on the sealing lid is identical with the axial direction of the shaft tube.

In the retractable-nib writing tool, it is possible to use a structure in the plurality of thin line portions are arranged along the inner circumferential face of the shaft tube and a lubricant is applied to the surfaces of the plurality of thin line portions.

Further in the retractable-nib writing tool, it is possible to provide a plurality of contracted diameter portions in the thin line portions and to make the thin line portions bendable in those contracted diameter portions.

Also, in the retractable-nib writing tool, it is preferable for the tips of the plurality of thin line portions to be arranged at equal intervals along the outer circumferential part of the sealing lid.

Further in the retractable-nib writing tool, a soft member may be disposed intervening in a position where the sealing lid is opposite the sealing tube.

DETAILED DESCRIPTION OF THE INVENTION

First Embodiment

Figure 1:
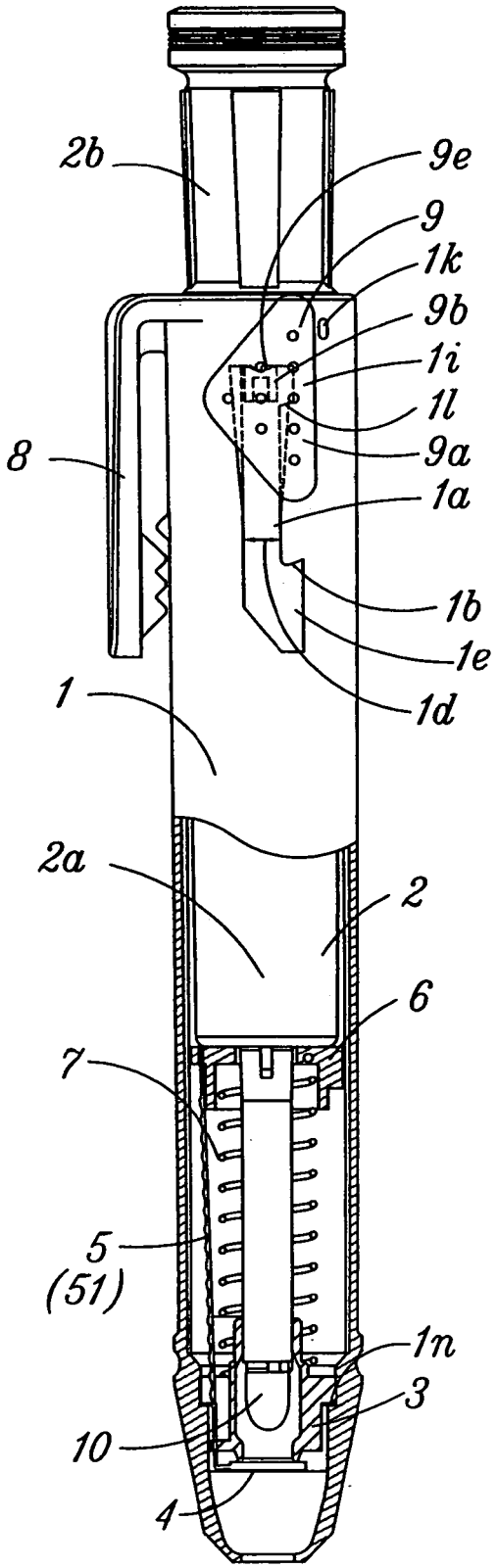
FIG. 1 is a longitudinal sectional view of an essential part of a retractable-nib writing tool, which is a first preferred embodiment of the present invention, showing a state in which its writing body is retracted.
Figure 7:
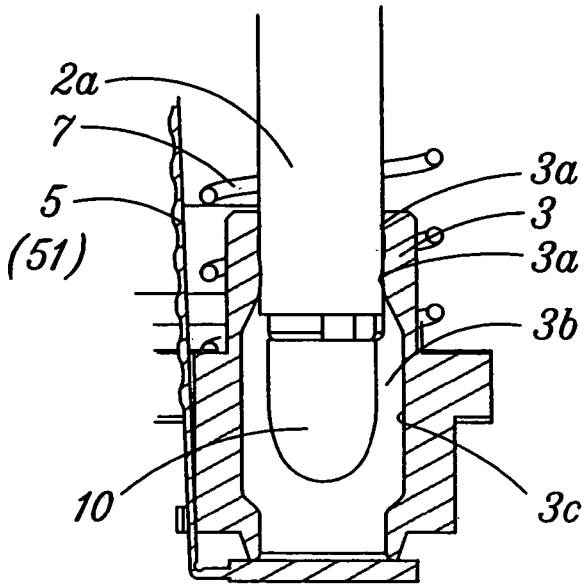
FIG. 7 shows an expanded view of another essential part of FIG. 1.

A first preferred embodiment of the present invention will be described with reference to FIG. 1 through FIG. 10. FIG. 1 is a partial longitudinal section showing a state in which a writing body 2 is retracted, i.e., a state in which a sealing lid 4 is sealed. A sealing tube 3 urged forward by a springy or resilient member 7 is set in the forward part within a tubular member or shaft tube 1, and the sealing tube 3 is prevented from coming off the shaft tube 1 by the engagement of its forward end with a stepped portion 1n, but the sealing tube 3 may as well be formed integrally with the inner face of the shaft tube 1. Inner ribs 3*a* for keeping sealed closure with the forward outer wall of the writing body 2 are formed on the rear inner face of the sealing tube 3 as shown in FIG. 7. Whereas three flexible elongate members in the form of thin line portions 51, 52 and 53 are formed radially from the sealing lid 4 and at equal intervals (120 degree intervals) in a unitary structure in this embodiment (see FIGS. 4 and 5), they need not be limited to this number but should preferably be disposed in equally spaced positions, and may as well be formed as separate units.

Figure 10:
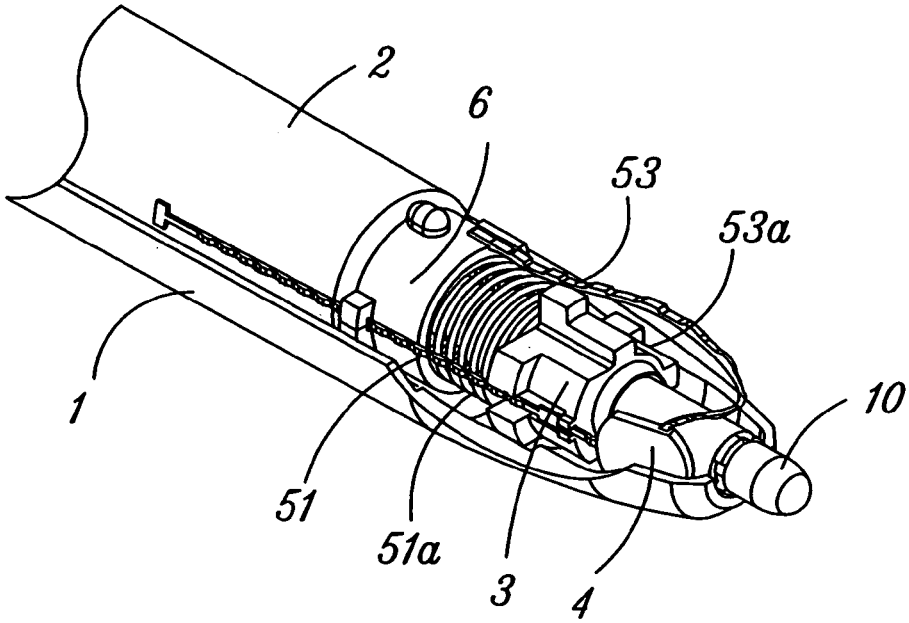
FIG. 10 shows a perspective view of an essential part for illustrating the operation of the retractable-nib writing tool of FIG. 1.

The surfaces of the flexible elongate members or thin line portions 51, 52 and 53 are coated with a lubricant, but the lubricant may as well be mixed and kneaded together with the resin simultaneously with their molding. Satisfactory examples of the lubricant include silicone oil, wax, talc and grease, but a fluid material such as silicone oil is preferable in respect of the coating case. While the rear ends of the thin line portions 52 and 53 are fixed to a guide tube 6 as shown in FIG. 4 and FIG. 10, the thin line portion 51 is slidably fitted to the guide tube 6.

The springy member 7 is resiliently compressed between the guide tube 6 and the sealing tube 3 as shown in FIG. 1 so that the sealing lid 4 is pressed backward by an urging force of the springy member 7 to keep the sealed closure between the sealing lid 4 and the sealing tube 3. The sealed closure between the sealing lid 4 and the sealing tube 3 may be direct closure between the sealing lid 4 and the sealing tube 3 as in this embodiment, but it may as well be closure formed via a soft member. Similarly, the sealed closure between the inner face of the sealing tube 3 and the forward part of the writing body 2 may also be accomplished by a ringshaped soft member, for instance an O-ring consisting of rubber or resin. Further the linking portions between the rear ends of the thin line portions 52 and 53 and the guide tube 6 constitute arciform wide bases 6*a*. By making the bases 6*a* wider than the rest of the thin line portions, deterioration or cutting of those parts which might otherwise occur from repeated bending is prevented (see FIG. 5 and FIG. 6).

The sealing tube 3 will be described in further detail. While the inside of the sealing tube 3 constitutes an inner space 3*b* as shown in FIG. 1 and FIG. 7, the inner diameter of the inner space 3*b* is substantially equal to the outer diameter of the writing nib 10 of the writing body 2. By keeping the inner space 3*b* as small as practicable, not only the drying of the writing nib 10 but also the drying of ink from the writing nib 10 can be prevented. In FIG. 7, a large diameter portion 3*c* is disposed in the position in the inner space 3*b* matching the writing nib 10. This is intended to prevent ink sticking to the writing nib 10 from being transferred to the inner space 3*b* as well as oozing of ink to the inner ribs 3*a* by a capillary phenomenon. In this embodiment, the large diameter portion is barely large enough not to allow any capillary phenomenon to occur, and more specifically its inner diameter is larger than other portions by about 0.8 mm, but a difference of 0.6 mm to 1.0 mm would give a similar effect.

Figure 4:
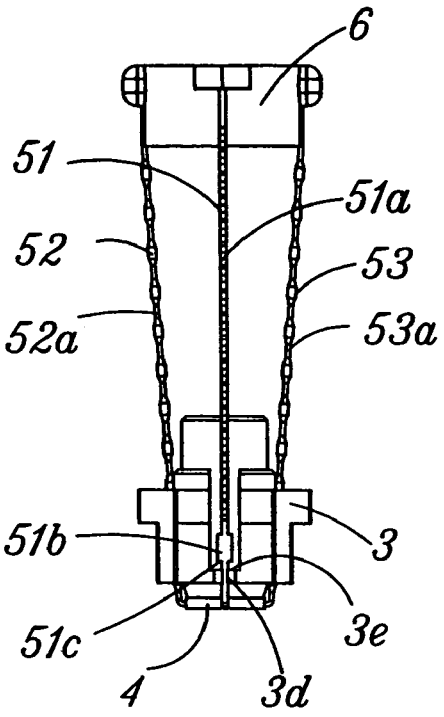
FIG. 4 shows an expanded view of another essential part of FIG. 1.
Figure 6:
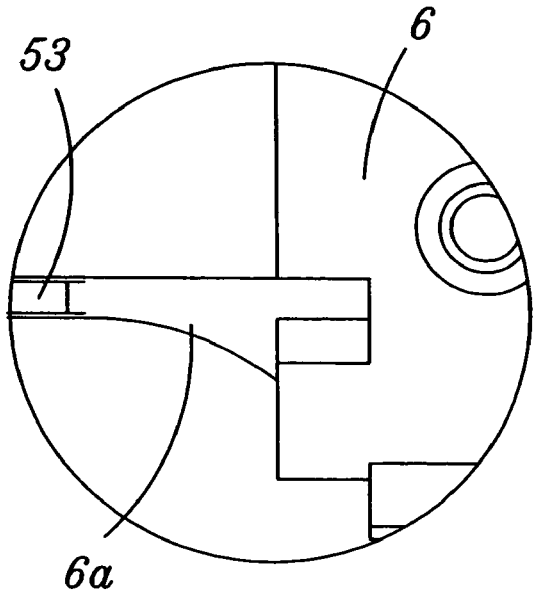
FIG. 6 shows an expanded view of an essential part of FIG. 5.
Figure 5:
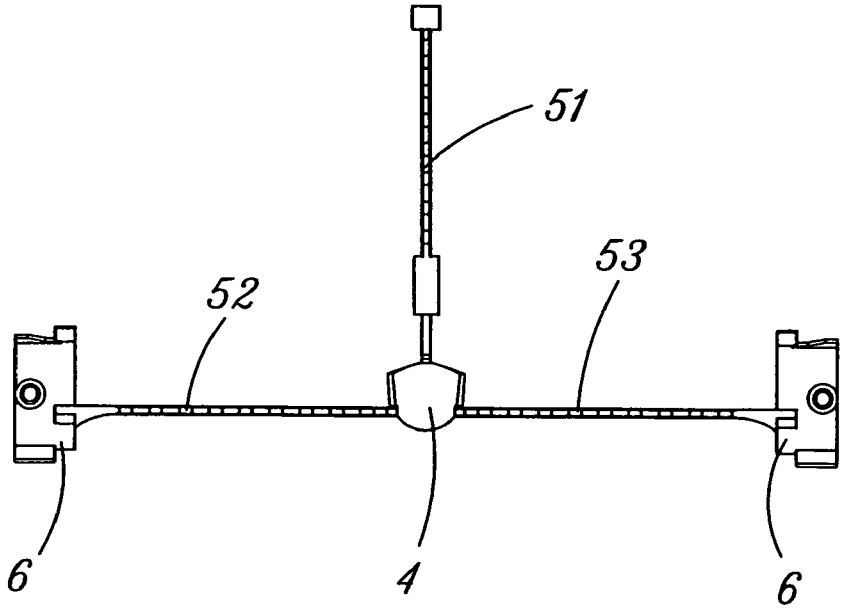
FIG. 5 shows a developed view of FIG. 4.

The thin line portions 51, 52 and 53 are in part provided with a plurality of contracted diameter portions 51*a*, 52*a* and 53*a* in a regular way as shown in FIG. 4. Advancing of the writing body 2 of the guide tube 6 fixed to the writing body 2 causes the contracted diameter portions 51*a*, 52*a* and 53*a* to be readily bent and deformed within the shaft tube 1. In FIG. 4, a bulged or enlarged portion 51*b* is provided on the thin line portion 51, and the bulged portion 51*b* restricts the advancing of the thin line portion 51 along with the advancing movement of the guide tube 6 by engaging with engaging step portions 3*e* protruding from an outer side face of the sealing tube 3 (i.e. obstruction of the advancing movement by a contracted or reduced diameter portion 3*d* between the engaging step portions 3*e*). Although the thin line portion 51 is therefore restricted, the two other thin line portions 52 and 53 advance, and therefore the sealing lid 4 rotates around the vicinity of the tip of the thin line portion 51, i.e., the sealing lid 4 pivots about the region where the front end of the thin line portion 51 connects to the sealing lid, and the sealing lid 4 opens the front end of the sealing tube 3 to make writing possible (see FIG. 9).

The sealing force for sealed closure of the writing nib of the writing body 2 should preferably be 50 to 100 kPa as determined by a method of measuring sealing force to be described afterwards, and more preferably to be 60 to 80 kPa in particular. There are two sealed positions which will require this sealing force including, as shown in FIG. 7, the sealed portion between the sealing tube 3 the sealing lid 4, and the sealed portion between the inner ribs 3*a* formed on the inner wall behind the sealing tube 3 the writing body 2. The sealing force required in these sealed positions is as described above; if the sealed force is less than 50 kPa, the ink solvent will permeate and volatilize from the sealed positions, eventually resulting in a problem that the written line becomes faint and blurred when the durability is considered. If the sealed force surpasses 100 kPa, as the load on the springy member 7 will then have to be increased, there will arise a problem that the thin line portions 51, 52 and 53 urging the sealing lid 4 by pressing backward with the springy member 7 break down on the way or stretch over time or a problem that the force required for a knocking operation to protrude or retract the writing body 2 will increase to make the operation more difficult. Therefore, by keeping the sealing force within the abovedescribed range, the sealed state of the writing nib 10 of the writing body 2 is kept satisfactory, making the retractable-nib writing tool to let protrusion and retraction be easily accomplished while securely preventing drying.

Further, at least one of the sealing tube 3 and the sealing lid 4 for sealing the writing nib 10 of the writing body 2 is composed of a material excelling in non-transmissivity for gas. Preferably it should be composed to satisfy the requirement that the water vapor transmissivity prescribed under ASTMF 1249 is not more than 3.0 (g. mm/m$^2$.day) under the condition of 37.8° C. (90% RH) or, more preferably, to satisfy the requirement that the water vapor transmissivity prescribed under ASTMF 1249 is not more than 1.0 (g. mm/m$^2$.day) under the condition of 37.8° C. (90% RH), and where this is met, there is no limitation to the material. Specific examples of the material include acrylonitrile butadiene rubber (NBR) such as butyl rubber (IIR), ethylene propylene rubber (EPDM), silicone rubber, chloroprene rubber (CR), urethane rubber (U), fluororubber (FKM), chlorosulfonic polyethylene rubber (CSM) and olefinic thermoplastic elastomers, and they also include blends of some of these rubbers and blends of one of these rubbers with a resin material. Particularly preferable ones include butyl rubber (IIR) excelling in non-transmissivity for gas and olefinic thermoplastic elastomers containing a butyl rubber content.

Figure 9:
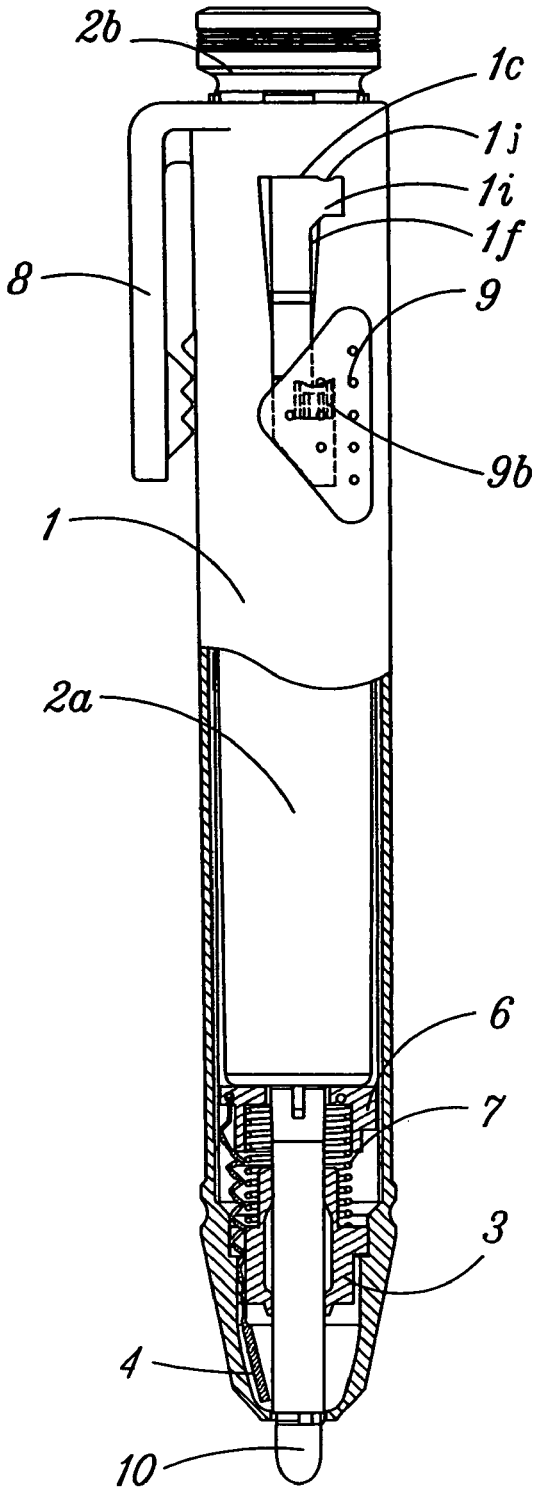
FIG. 9 shows an essential part of a retractable-nib writing tool in a state in which the tip of the writing body protrudes.

Further, it is desirable that at least one of the sealing tube 3 and the sealing lid 4 in this embodiment be composed of a material which is a rubber or an elastic resin whose Shore hardness as prescribed under ASTMD 2240 is 20 degrees to 90 degrees, and more preferably 50 degrees to 80 degrees in Shore hardness. The reason is that, in order to achieve a writing state as shown in FIG. 9, the writing body 2 should slide within the sealing tube 3; however, the outer wall ahead of the writing body 2 and the inner ribs 3*a* of the sealing tube 3 should be in sealed contact with each other; therefore, if the hardness is too high, the writing nib will not slide smoothly on the sealing tube 3 because the outer wall of the writing body 2 and the inner ribs 3*a* are press-fitted to achieve the sealed closure, and the inner ribs 3*a* may tend to be deformed and shaved as a result of deterioration over time; conversely, if the hardness is too low, it cannot be readily released from the metallic mold in injection molding, resulting in poor productivity, and this will be unrealistic; accordingly, by selecting the hardness in the above-stated range, the writing nib of the writing body 2 can be kept in sealed closure, and can slide smoothly when protruded or retracted while drying is securely prevented. Thus, there is provided a retractable-nib writing tool excelling in the balance between sealed closure and sliding smoothness.

Figure 11:
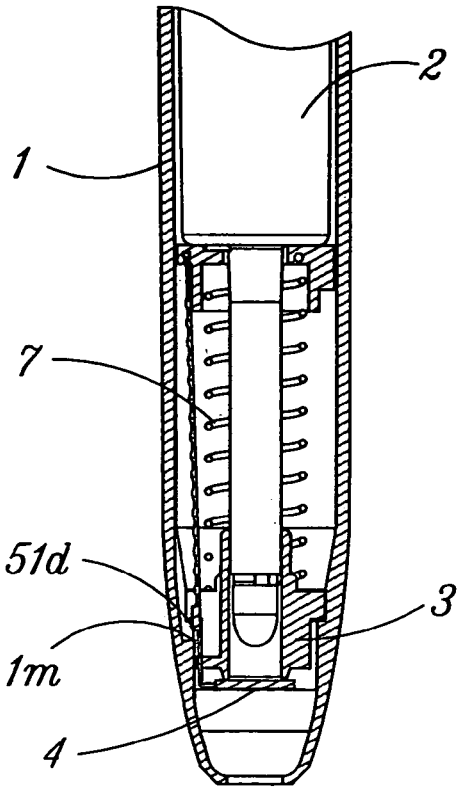
FIG. 11 is a longitudinal sectional view of an essential part showing a variation of engaging step portions.

FIG. 11 shows a variation of the engaging step portions 3*e*. A protrusion 51*d* is provided ahead of the thin line portion 51, and an engaging step portion 1*m* for engaging with the protrusion 51*d* is further provided on the inner face of the shaft tube 1. The engagement between these protrusion 51*d* and engaging step portion 1*m* restricts the forward motion of the thin line portion 51.

Figure 2:
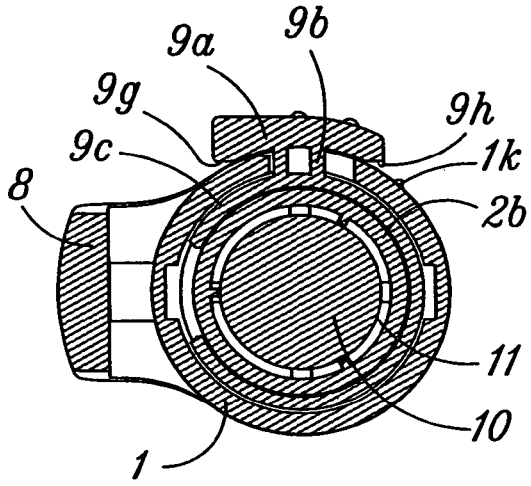
FIG. 2 shows a lateral sectional view of FIG. 1.
Figure 3:
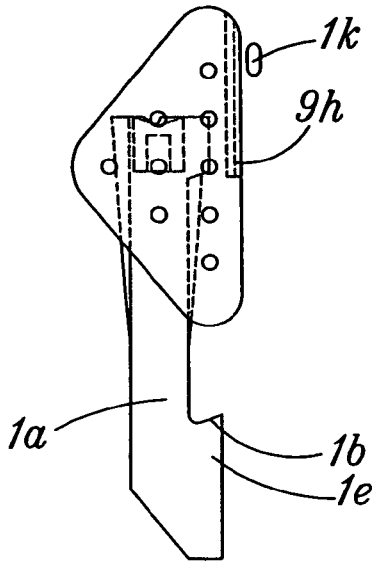
FIG. 3 shows an expanded view of an essential part of FIG. 1.

Whereas a clip 8 in FIGS. 1 and 2 is formed integrally with the shaft tube 1, it may be composed of a separate member, each member to be fixed to each other. Further, a knocking member 2*b* is positioned behind the writing body 2, and pressing this knocking member 2*b* causes the writing body 2 to move forward to protrude out of the tip of the shaft tube 1. A sliding piece 9 is linked to the knocking member 2*b*, and this piece, when the writing body 2 is protruding, is engaged with an engaging portion 1*b* of a guide groove 1*a* formed in the shaft tube 1. And when the sliding piece 9 is turned in the radial direction, the engagement is released, and the springy force of the springy member 7 causes the writing body 2 to retreat and the sealing lid 4 again seals the sealing tube 3.

Figure 8:
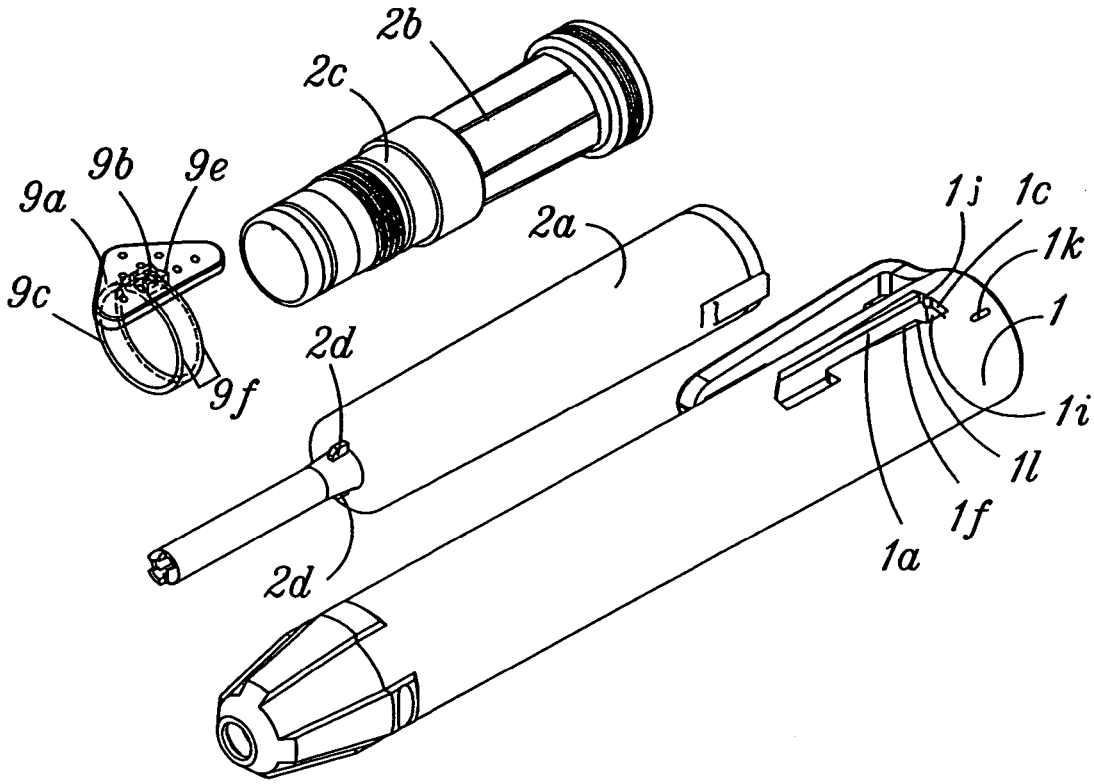
FIG. 8 shows an exploded perspective view of FIG. 1.

A tip opening hole through which the tip of the writing body 2 slides to achieve protrusion or retraction is formed at the tip of the shaft tube 1 as shown in FIGS. 1, 8 and 9, and a rear end opening hole, through which the knocking member 2*b* constituting the writing body 2 can be slidably arranged at the rear end of the same. Further in a side of the shaft tube 1, there is formed the guide groove lain which the sliding piece 9 can slide in the lengthwise direction and the engaging portion 1*b* is formed toward the tip. The rear end of that guide groove 1*a* is not linked to the rear end opening of the shaft tube 1, and the guide groove 1*a* forms a window which closes on a side of the shaft tube 1. Thus the tip and the rear end (rear end 1*c*) of the guide groove 1*a* are blocked. The rear end 1*c* of the guide groove 1*a* also serves as the engaging portion of the sliding piece 9 when the writing body 2 is retracted into the shaft tube 1.

Further, from the rear end 1*c* of the guide groove 1*a*, a restricting groove 1*i* is formed in the circumferential direction as shown in FIG. 8. When the tool is shipped out of the factory or is not in use, inadvertent projection or retraction is prevented by turning the sliding piece 9 in the circumferential direction of the shaft tube 1 positioning a base 9*b* in the restricting groove 1*i*. Also, in order not to let the sliding piece 9 (the base 9b) be easily returned on this occasion, the sliding piece 9 the shaft tube 1 can engage with each other. More specifically, a projection 9*h* disposed on the under face of the sliding piece 9 engages with a projection 1*k*(see FIG. 3) disposed on the outer circumferential face of the shaft tube 1. Though the base 9*b*(the sliding piece 9) and the knocking member 2*b* are formed of separate members to be engaged with and fixed to each other in this embodiment, they may as well be integrally formed by means of injection molding or cutting.

Here, as shown in FIG. 8, an inclined face portion 11 inclined in the projecting direction of the writing body 2 is formed on the bottom (forward end) of the restricting groove 1*i*. This allows the base 9*b* to move ahead past the inclined face portion 11 when excessive protrusion is operated in a state in which the base 9*b* is positioned in the restricting groove 1*i*. Thus, the restricting groove 1*i* and the base 9*b* are thereby prevented from being damaged by an inadvertent or excessive protruding operation. Incidentally, it is so arranged in this embodiment that, when a protruding force of about 3.0 kg to 5.0 kg works, the base 9*b* passes the inclined face portion 11 and goes off the restricting groove 1*i* to reach the guide groove 1*a*.

Further, a projection 1*j* is formed downward at the rear end 1*c* of the guide groove 1*a* to allow a concave inclined portion 9*e* of the base 9*b* to be engaged, which will be described presently. Thus, when the tool is being used, the sliding piece 9 is thereby prevented from inadvertently turning relative to the shaft tube 1.

The sliding piece 9 comprises, outside the shaft tube 1, a button portion 9*a*, the base 9*b* sliding and engaging within the guide groove 1*a* and, inside the shaft tube 1, an inward portion 9*c* for embracing the writing body 2. As shown in FIG. 1, the rear part of the base 9*b* of the sliding piece 9 is arranged either in contact with, or with a slight gap from the rear end 1*c* of the guide groove 1*a*.

Further, the inward portion 9*c* of the sliding piece 9 embraces the writing body 2, and the sliding piece 9 is arranged to be rotatable around the lengthwise axis (the center axis of the shaft tube 1). More specifically, a writing body portion 2*a* and the knocking member 2*b* are detachably linked and fixed by screwing, and to its screwing part the inward portion 9*c* of the sliding piece 9 is loosely fitted. Thus the inward portion 9*c* is integrated with the writing body 2 in a state of being squeezed by the writing body portion 2*a* and the knocking member 2*b*. Further, the writing body portion 2*a* and the knocking member 2*b* are linked by screwing, and the forward portion of the screwing structure constitutes an airtight structural part. Specifically, in the airtight structure, a circumferential rib formed on the inner face of the writing body portion 2*a* comes into contact with a planar portion 2*c* formed in the knocking member 2*b*, and they are pressed against, deformed by and tightly adhere to each other. This results in a screwing structure which prevents, or hardly permits, evaporation of ink in an ink absorbent, which will be described presently, from the airtight structural part.

Further, whereas the ink absorbent consisting of a fiber bundle is inserted within the writing body portion 2*a* and the knocking member 2*b* linked by the airtight structure, it may as well be formed of a porous material such as sponge, urethane or cotton. And whereas a coat consisting of a thin filmy material is wound around the ink absorbent, consisting of the fiber bundle, a plurality of through holes may be formed in the coat.

Next, the operation will be described. When the knocking member 2*b* is moved forward relative to the shaft tube 1, the writing body portion 2*a* (the writing body 2) moves forward against the springy force of the springy member 7. When this takes place, the thin line portions 51, 52 and 53 also move forward and are released from their tense state, and the sealing lid 4 is opened. When the knocking member 2*b* is moved further ahead, the writing body portion 2*a* moves ahead to cause its tip to protrude out of the tip opening of the shaft tube 1 as shown in FIG. 9. Whereas the thin line portions 52 and 53 are in a state of being bent while being in a sliding contact with the inner face of the shaft tube 1 in this protruding state, this sliding motion takes place smoothly because of the presence of the lubricant, resulting in a bent state like an arc (see FIG. 10).

When the knocking member 2*b* is moved further ahead hereupon, the concave inclined portion 9*e* formed behind the base 9*b* of the sliding piece 9 is engaged with the acute engaging portion (projection) 1*b* of the shaft tube 1 to enable the writing state to be maintained. By appropriately turning the button portion 9*a* of the sliding piece 9 in this state around the lengthwise axis, the engagement between the base 9*b* of the sliding piece 9 and the engaging portion 1*b* of the guide groove 1*a* is released, enabling the writing body 2 to shift to the retracted state.

Second Embodiment

Figure 14:
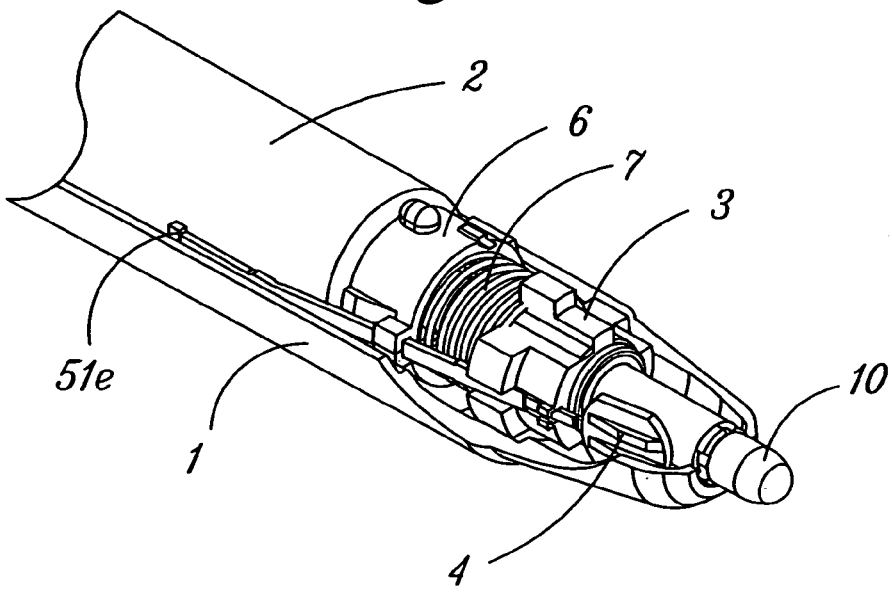
FIG. 14 shows a perspective view of FIG. 13.

A second preferred embodiment of the invention is shown in FIG. 12 through FIG. 15. The plurality of flexible elongate members in the form of thin line portions 51, 52 and 53 are formed integrally with the sealing lid 4 as in the first embodiment. However, though the rear ends of two thin line portions 52 and 53 are fixed to the guide tube 6, the other thin line portion 51 is loosely inserted into a guide through groove 6*c*(or a through hole) provided in an outer side of the guide tube 6, and not so many contracted diameter portions are formed as in the foregoing first embodiment. Also, an engaging step portion 51*e* is disposed near the rear end of the thin line portion 51 as shown in FIG. 14, and the engaging step portion 51*e* is to be engaged with the through groove 6*c*. Thus, when the writing body 2 is retracted, as the engaging step portion 51*e* is engaged with an engaging step portion 6*b* disposed near the through groove 6*c* on the outer face of the guide tube 6, together with the two other thin line portions 52 and 53 it presses backward the sealing lid 4 by the urging of the springy member 7, with the result that the sealing lid 4 the sealing tube 3 are thereby sealed together.

Figure 15:
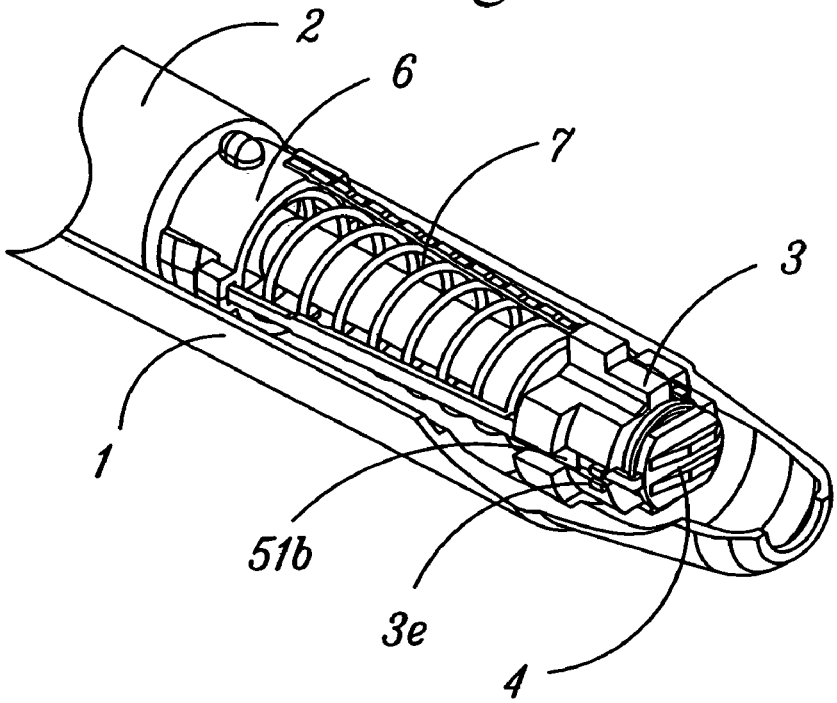
FIG. 15 is a perspective view which illustrates the operation of the retractable-nib writing tool of FIG. 12, showing a state in which its writing body is retracted.

Also, at a forward portion of the thin line portion 51, as in the first embodiment, the bulged portion 51*b* is disposed as shown in FIG. 15, and its contact with an engaging step portion 51*c* formed on an outer side face of the sealing tube 3 restricts the thin line portion 51 from moving forward beyond a certain limit along with the forward movement of the guide tube 6. Further, as the two other thin line portions 52 and 53 move forward while being bent and deformed along with the forward movement of the guide tube 6, the sealing lid 4 turns around the vicinity of the tip of the thin line portion 51 and expands to achieve the writing state. As the rear part of the thin line portion 51 then is loosely inserted into the guide tube 6, it can move ahead simultaneously with the guide tube 6 as in the first embodiment, but it can also stay on though it somewhat advances relative to the shaft tube 1.

In the first embodiment, the thin line portion 51 requires sufficient flexibility to allow bending and displacement in the limited space in the writing state, and needs sufficient strength to maintain tension when the sealing lid 4 is in sealed closure. However, depending on the thickness of the writing body 2, it may be preferable for the thin line portion 51 to stay within the shaft tube 1 rather than to be mainly bent and deformed. An example of such a case is the second embodiment. Of course, combined use of the two methods, i.e. bending/deformation and loose insertion into the outer side face of the guide tube 6, is also conceivable.

Figure 12:
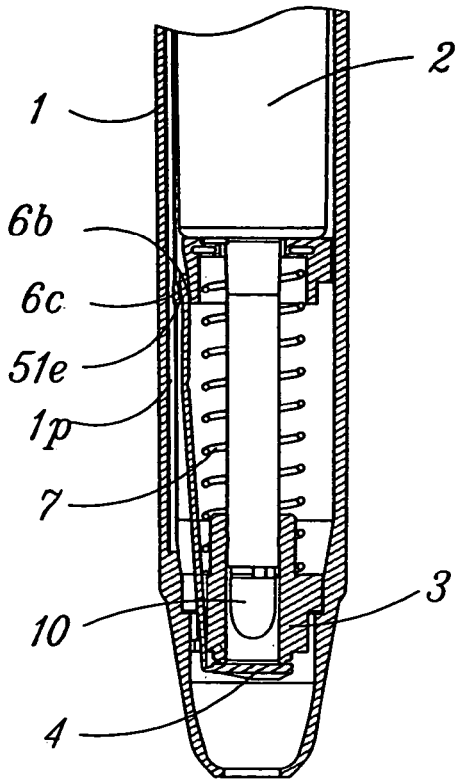
FIG. 12 is a longitudinal sectional view of an essential part of a retractable-nib writing tool, which is a second preferred embodiment of the invention.
Figure 13:
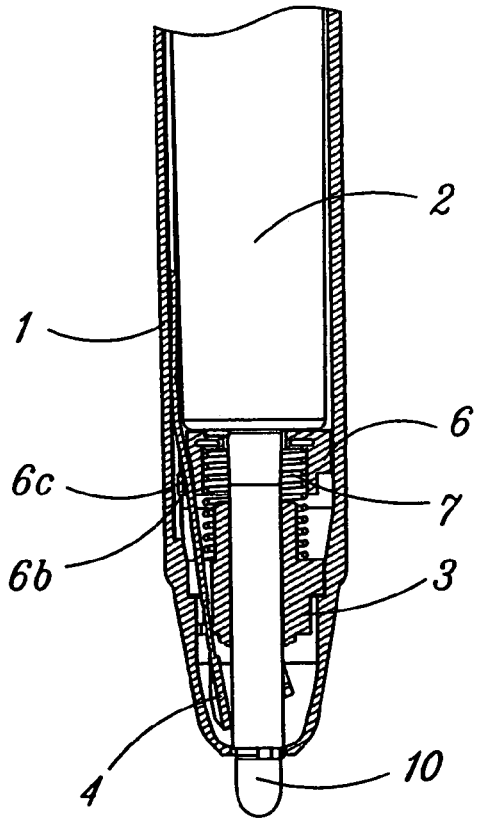
FIG. 13 is a longitudinal sectional view of an essential part for illustrating the operation of the retractable-nib writing tool of FIG. 12 in a state in which the tip of the writing body protrudes.

In this embodiment, in order not to allow the relative back-and-forth motions of the writing body 2 the shaft tube 1 to be disturbed even when the rear part of the thin line portion 51 remains within the shaft tube 1 in the writing state, a groove-shaped portion lp is formed within the shaft tube 1 as shown in FIG. 12 the rear part of the thin line portion 51 is arranged in the groove-shaped portion 1*p*, with the result that the back-and-forth motions of the writing body 2 can be accomplished smoothly. Though not shown, a groove which corresponds to the grooveshaped portion may as well be formed on the writing body 2 side, or alternatively the gap between the shaft tube 1 the writing body 2 may be formed to be sufficiently wide relative to the thickness of the thin line portion 51.

[Fitting for Sliding Piece and Its Modifications]

Figure 16:
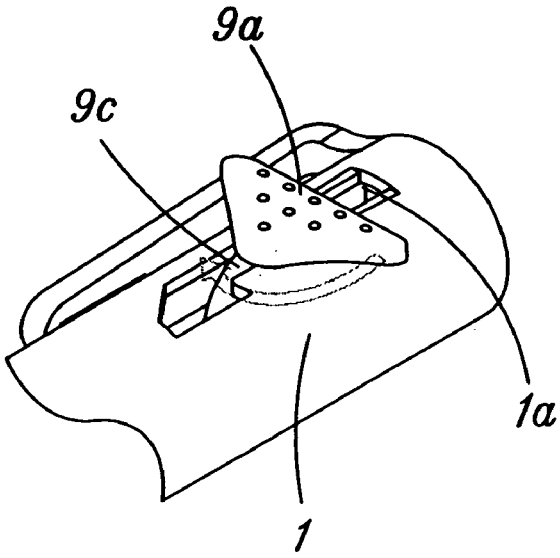
FIG. 16 shows a perspective view of an essential part for illustrating the method of fitting a sliding piece.

Next will be described the method of fitting the sliding piece 9 to the shaft tube 1. In FIG. 16 which shows a perspective view of the process of fitting the sliding piece 9 to the shaft tube 1, the width 9*f* of the inward portion 9*c* (see FIG. 8) allows insertion relative to a shaft tube guide groove width 1*d* (see FIG. 1); first, the writing body portion 2*a* is inserted into the shaft tube 1, next the inward portion 9*c* can be readily arranged within the shaft tube 1 by turning the sliding piece 9 by about 90°, and assembly is completed by turning the sliding piece 9 by 90° after that.

Next, the knocking member 2*b* is penetrated through the inward portion 9*c*, and then the knocking member 2*b* is fixed to the writing body portion 2*a* by screwing to complete the product.

Though the width of the inward portion 9*c* allows insertion into the width of the guide groove 1*a* of the shaft tube 1 as shown in FIG. 16, press fitting is also acceptable or, alternatively, the groove shaft near the engaging portion 1*b* of the shaft tube 1 may be formed large enough, and the width 9*f* of the inward portion 9*c* is chosen to allow assembly by turning it in this part.

Figure 17:
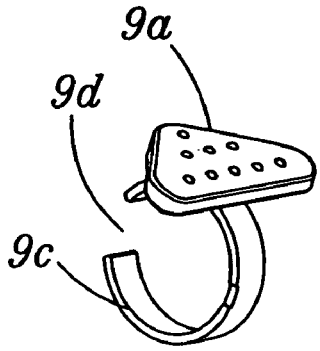
FIG. 17 shows an external perspective view of a variation of the sliding piece.

Further, the inward portion 9*c* of the sliding piece 9 need not be closed, but a partly cut C ring shape (see FIG. 17) or a partial arc is also conceivable.

Figure 18:
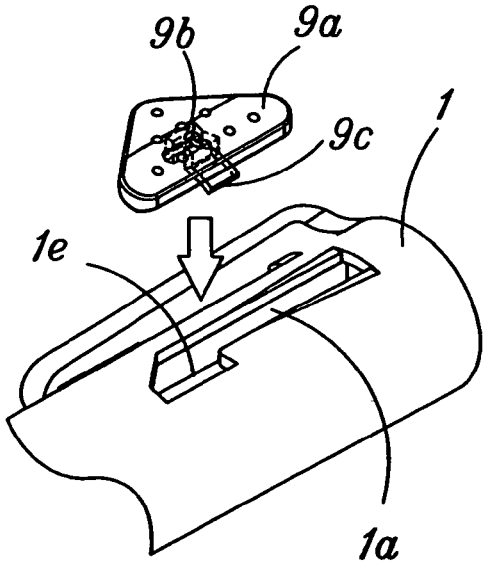
FIG. 18 shows an external perspective view of an essential part of a variation of the sliding piece.
Figure 19:
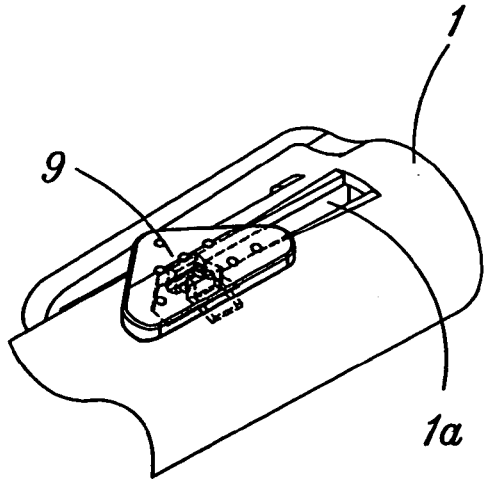
FIG. 19 shows an external perspective view of the sliding piece of FIG. 18 in its fitted state.

FIG. 18 shows another variation of the sliding piece 9. Fitting of the sliding piece 9 to the shaft tube 1 can be accomplished by snapping it in while contractively deforming the inward portion 9*c* in a wider portion 1*e* near the engaging portion 1*b* of the guide groove 1*a*. FIG. 19 shows a state of being assembled into a writing tool, a perspective view showing the retracted state of the writing body 2. Since assembly is possible without having to turn the sliding piece 9 as in the foregoing example, the assembling procedure can be simplified.

Figure 20:
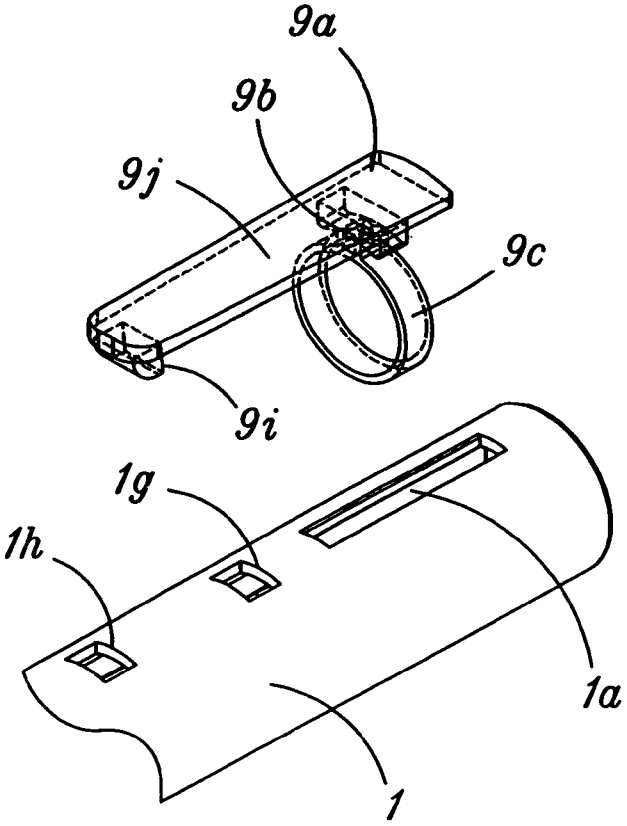
FIG. 20 shows an external perspective view of an essential part of a variation of the sliding piece.
Figure 21:
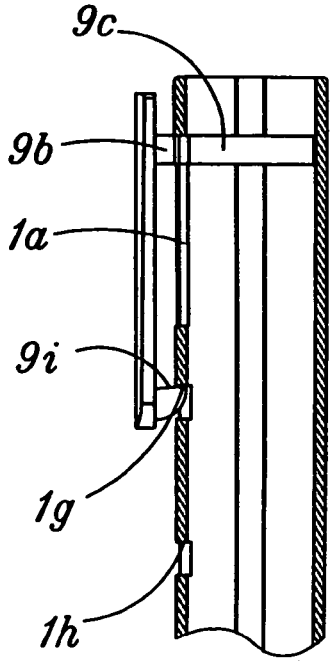
FIG. 21 is a longitudinal sectional view of an essential part of the sliding piece of FIG. 20 in its fitted state.

FIG. 20 and FIG. 21 show still another variation of the sliding piece 9, wherein a clip portion 9*j* is integrally formed with the button portion 9*a* of the sliding piece 9. An engaging portion 9*i* is disposed on the clip ball part of the clip portion 9*j*, and the tool can be kept in the writing state by engaging that engaging portion 9*i* with an engaging hole 1*h* provided in a side of the shaft tube 1 in the retracted state by engaging it with an engaging hole 1*g* provided behind the engaging hole 1*h*. The method of its fitting to the shaft tube 1 is similar to the method illustrated in FIG. 16.

EXAMPLE OF EXPERIMENT

The retractable-nib writing tool described above was subjected to measurement of the sealing force and evaluation of its durability over time.

<Method of Measuring Sealing Force>

In the state shown in FIG. 1, the knocking member 2*b* is removed from the writing body 2, and a silicon tube is linked to the rear end of the writing body 2 in a sealed state (not shown). The other end of the silicon tube is linked in a sealed state to a leak tester (product of Tokyo Seimitsu Co., Ltd.). The shaft tube 1 on the sealing tube 3 side is about half soaked in a suitable vessel. In this state, air pressure of a desired level is supplied from the leak tester for 12 seconds, and the limit value of air pressure where no bubble is generated from the sealed part between the sealing tube 3 and the sealing lid 4 or from the sealed part between the forward outer wall part of the writing body 2 and the inner ribs 3*a* is determined to represent the sealing force.

<Evaluation of Durability over Time>

In the state shown in FIG. 1, an ink absorbent (acryl-made) is arranged in the writing body 2, and filled with 3.0 g of alcoholic oil-based ink, whose main solvent is ethanol. A pen core (acryl-made) is press-fitted to the tip of the writing body 2, and the other end of the pen core is pressed into the ink absorbent. Samples are classified by the above-described method of the sealing force, and the water vapor transmissivity of the different materials of the sealing tube 3 are determined as follows.

Sample 1: 20 kPa<0.6 in water vapor transmissivity>
Sample 2: 30 kPa<0.6 in water vapor transmissivity>
Sample 3: 40 kPa<0.6 in water vapor transmissivity>
Sample 4: 50 kPa<3.2 in water vapor transmissivity>
Sample 5: 50 kPa<0.6 in water vapor transmissivity>
Sample 6: 60 kPa<1.2 in water vapor transmissivity>
Sample 7: 80 kPa<2.4 in water vapor transmissivity>
Sample 8: 100 kPa<2.4 in water vapor transmissivity>
Sample 9: 110 kPa<0.6 in water vapor transmissivity>

Each sample, after being allowed to stand in a lateral position for 1 day at 50° C., is let stand for 1 hour at room temperature, and tested for writing on good-quality paper. After that, after being allowed to stand continuously in a lateral position for 7 days the sample was at 50° C., is let stand for 1 hour at room temperature, and tested for writing on good-quality paper. The written result is checked in each case, and evaluated by direct observation according to the following criteria.

○: Writing possible without problem.

Δ: Written lines are somewhat faint and blurred.

X: Written lines are faint and blurred due to drying.

The results of evaluating the durability over time are listed in Table 1.

TABLE 1

| | Sealing force (kPa) | Water vapor transmissivity | 50° C., 1 day | 50° C., 7 days |
|---|---|---|---|---|
| Sample 1 | 20 | 0.6 | X | X |
| Sample 2 | 30 | 0.6 | Δ | X |
| Sample 3 | 40 | 0.6 | Δ | X |
| Sample 4 | 50 | 3.2 | ○ | Δ |
| Sample 5 | 50 | 0.6 | ○ | ○ |
| Sample 6 | 60 | 1.2 | ○ | ○ |
| Sample 7 | 80 | 2.4 | ○ | ○ |
| Sample 8 | 100 | 2.4 | ○ | ○ |
| Sample 9 | 110 | 0.6 | Δ | X |

As is evident from the results listed in Table 1, Samples 5 through 8 which fall within the scope of the present invention have a sealing force of 50 to 100 kPa, sufficient for adequately keeping the air-tightness of the sealed part between the sealing tube 3 and the sealing lid 4 or the sealed part between the forward outer wall part of the writing body 2 and the inner ribs 3*a*; they are thus materials excelling in non-transmissivity for gas, providing an adequate sealing force to manifest writing durability with no problem both after the lapse of a short period of time (1 day at 50° C.) and after that of a long period of time (7 days at 50° C.).

By contrast, Samples 1 through 4 and 9, which are outside the scope of the invention, because of their insufficient air-tightness, the ink solvent permeate the sealed part and the material, such as rubber, and volatilized, give such findings regarding durability over time that written lines dry up and become fuzzy, that is, faint and blurred. To consider each samples, Samples 1 through 3 are not more than 50 kPa in sealing force, with the consequence that the ink solvent penetrates the supposedly sealed part where the sealing force has weakened and volatilizes, and written lines become faint and blurred in the test for durability overtime. Further, Sample 4 in spite of its sealing force of 50 kPa, manifests a high water vapor transmissivity count, i.e. it is a material inferior in non-transmissivity, resulting in fuzzy or faint written lines after the lapse of a long period though posing no problem in a short period time. Sample 9, though made of a material superior in non-transmissivity for gas, imposes a heavy load on the springy member 7 because of its sealing force surpassing 100 kPa, and the thin line portions were extended in the test on heat resistance over time, and consequently, the urging force for pressing the sealing lid 4 backward was weakened, presumably resulting in the drying of the writing nib.

INDUSTRIAL APPLICABILITY

The present invention, by virtue of the structure and its actions, can solve the problems noted above and provide an excellent retractable-nib writing tool. Thus, the retractable-nib writing tool has a retractable writing body in a shaft tube and has a sealing lid and a sealing tube which seal the writing nib of the writing body in association with the forward and backward movements of that writing body, wherein the sealing lid and a guide tube fixed to the writing body are linked by a plurality of thin line portions, the sealing lid and thin line portions are formed integrally, and the sealing lid is opened and closed relative to the sealing tube by the forward and backward movements of those thin line portions; therefore when, the writing body is retracted, the writing nib can be securely sealed by the sealing lid and the sealing tube, making it possible to securely prevent drying.

The invention claimed is:

1. A retractable-nib writing tool having a retractable writing body slidable in forward and backward directions in a shaft tube and having a sealing lid and a sealing tube which seal a writing nib of the writing body in association with the forward and backward movements of the writing body, wherein: the sealing lid is independent of and not mounted to the sealing tube, the sealing lid and a guide tube fixed to the writing body are linked by a plurality of thin line portions, the thin line portions are disposed at equal intervals around the sealing lid and constitute therewith a unitary structure, and the sealing lid is opened and closed relative to the sealing tube by the forward and backward movements of the thin line portions; and wherein at least one thin line portion out of the plurality of thin line portions which are advanced by the forward motion of the guide tube is regulated and other thin line portions can be flexibly bent and deformed.

2. A retractable-nib writing tool according to claim 1; wherein both the sealing force between the sealing lid and the sealing tube and the sealing force between the writing nib and the sealing tube are set to 50 to 100 kPa.

3. A retractable-nib writing tool according to claim 1; wherein at least either one of the sealing lid and the sealing tube is composed of a material whose water vapor transmissivity prescribed under ASTMF 1249 is not more than 3.0(g. mm/m2.day) under the condition of 37.8° C. (90% RH).

4. A retractable-nib writing tool having a retractable writing body in a shaft tube and having a sealing lid and a sealing tube which seal the writing nib of the writing body in association with the forward and backward movements of the writing body, wherein: the sealing tube is fixed within the shaft tube, the sealing lid and a guide tube are arranged respectively ahead of and behind the sealing tube to fix the guide tube to the writing body and the guide tube and the sealing lid are linked with a plurality of flexible thin line portions, so configured that, while an opening at the forward end of the sealing tube is closed as the plurality of thin line portions keep the sealing lid in a state of being pressed against the sealing tube when the writing body is in a retracted position, the sealing lid turns to open the opening at the forward end of the sealing tube as the forward movement of any of the plurality of thin line portions relative to the sealing tube is restricted and those of the rest of the thin line portions are permitted when the writing body is to move forward.

5. A retractable-nib writing tool according to claim 4; wherein, out of the plurality of thin line portions, the thin line portion whose forward movement is to be regulated is provided with a bulged portion, and the outer circumferential part of the sealing tube is provided with engaging step portions to engage with the bulged portion when the writing body moves forward.

6. A retractable-nib writing tool according to claim 4; wherein the plurality of thin line portions comprises at least three thin line portions.

7. A retractable-nib writing tool according to claim 4; wherein a springy member is disposed between the sealing tube and the guide tube and, when the writing body is in a retracted position, the plurality of thin line portions keep the sealing lid in a state of being pressed against said sealing tube by the urging of said springy member.

8. A retractable-nib writing tool according to claim 7; wherein the plurality of thin line portions are arranged between the guide tube and the sealing lid so that, when the writing body is in the retracted position, the direction of the force working from the plurality of thin line portions on the sealing lid is identical with the axial direction of the shaft tube.

9. A retractable-nib writing tool according to claim 4; wherein the plurality of thin line portions are arranged along the inner circumferential face of the shaft tube and a lubricant is applied to the surfaces of the plurality of thin line portions.

10. A retractable-nib writing tool according to claim 4; wherein the thin line portions each have a plurality of reduced-diameter portions along the length thereof, and the thin line portions can be bent at the reduced-diameter portions.

11. A retractable-nib writing tool according to claim 4; wherein the tips of the plurality of thin line portions are arranged at equal intervals along the outer circumferential part of the sealing lid.

12. A retractable-nib writing tool according to claim 4; wherein a soft member is disposed in a position where the sealing lid is opposite the sealing tube.

13. A writing tool comprising:

a tubular member having an open front end; a writing body axially slidable in the tubular member between a forward position in which a writing nib of the writing body extends through the open front end of the tubular member and a rearward position in which the writing nib is retracted into the tubular member; a sealing tube disposed in the tubular member at a front portion thereof and having a front end through which the writing nib passes as the writing body moves forward in the tubular member to its forward position and behind which the writing nib retracts when the writing body is in its rearward position; a sealing lid disposed forwardly of the front end of the sealing tube and being movable to open and close the front end of the sealing tube; a guide tube slidably disposed in the tubular member to undergo axial sliding movement with the writing body and through which extends a portion of the writing body; a spring disposed in the tubular member and interposed between the sealing tube and the guide tube to resiliently urge the guide tube and the writing body rearwardly to normally position the writing body in its rearward position; and a plurality of flexible elongate members each connected at a front end thereof to the sealing lid, one or more of the flexible elongate members being connected to the guide tube so that when the guide tube moves rearwardly the one or more flexible elongate members pull the sealing lid to close the front end of the sealing tube and when the guide tube moves forwardly the one or more flexible members slacken to permit the sealing lid to open the front end of the sealing tube, and another of the flexible elongate members being slidable relative to the guide tube and enactable with the sealing tube during forward movement of the writing body to restrict forward movement of the another flexible elongate member so that further forward movement of the writing body causes the sealing lid to pivot about the region where the front end of the another flexible elongate member connects to the sealing lid to open the front end of the sealing tube.

14. A writing tool according to claim 13; wherein the sealing lid and the flexible elongate members comprise a unitary structure.

15. A writing tool according to claim 13; wherein the plurality of flexible elongate members comprises at least three flexible elongate members arranged at equal intervals around the sealing lid.

16. A writing tool according to claim 13; wherein the flexible elongate members are disposed along an inner circumferential surface of the tubular member and are coated with a lubricant.

17. A writing tool according to claim 13; wherein the another flexible elongate member has an enlarged portion; and the sealing tube has an engaging portion positioned to engage with the enlarged portion during forward movement of the writing body to thereby prevent further forward movement of the another flexible elongate member while the writing body continues forward movement to its forward position.

18. A writing tool according to claim 17; wherein the engaging portion of the sealing tube comprises a step portion of the sealing tube that protrudes from an outer side face of the sealing tube.

19. A writing tool according to claim 13; further including a knocking member connected to a rear end of the writing body and projecting outwardly through an open rear end of the tubular member.

20. A writing tool according to claim 13; wherein the flexible elongate members comprise flexible line.

* * * * *